US011517996B2

(12) United States Patent
Takagi

(10) Patent No.: US 11,517,996 B2
(45) Date of Patent: Dec. 6, 2022

(54) POLISHING APPARATUS

(71) Applicant: Kioxia Corporation, Minato-ku (JP)

(72) Inventor: Jun Takagi, Yokkaichi (JP)

(73) Assignee: Kioxia Corporation, Minato-ku (JP)

( * ) Notice: Subject to any disclaimer, the term of this patent is extended or adjusted under 35 U.S.C. 154(b) by 274 days.

(21) Appl. No.: 16/898,599

(22) Filed: Jun. 11, 2020

(65) Prior Publication Data

US 2021/0069854 A1 Mar. 11, 2021

(30) Foreign Application Priority Data

Sep. 10, 2019 (JP) ..... JP2019-164572

(51) Int. Cl.
*B24B 5/00* (2006.01)
*B24B 37/20* (2012.01)

(52) U.S. Cl.
CPC ..... *B24B 37/20* (2013.01)

(58) Field of Classification Search
CPC ..... B24B 37/20; B24B 57/02
USPC ..... 451/290, 60, 41, 297, 5
See application file for complete search history.

(56) References Cited

U.S. PATENT DOCUMENTS 6,447,368 B1 * 9/2002 Fruitman ..... B24B 49/04 451/287
7,108,592 B2 9/2006 Fukaya et al.
9,105,516 B2 8/2015 Nakamura
9,539,699 B2 1/2017 Shinozaki
9,662,761 B2 * 5/2017 Shinozaki ..... B24B 37/04
2004/0142635 A1 * 7/2004 Elledge ..... B24B 37/30 451/287
2007/0167110 A1 * 7/2007 Tseng ..... B24B 37/30 451/5
2015/0111477 A1 * 4/2015 Suen ..... B24B 37/30 451/60
2017/0291274 A1 10/2017 Shinozaki et al.

FOREIGN PATENT DOCUMENTS

JP 2005-14128 A 1/2005
JP 4086722 B2 5/2008
JP 5891127 B2 3/2016
JP 2016-72372 A 5/2016
JP 2017-185589 A 10/2017
JP 2017-190537 A 10/2017
JP 2018-130772 A 8/2018
JP 2018130772 * 8/2018 ..... B25J 15/08

* cited by examiner

*Primary Examiner* — Joseph J Hail
*Assistant Examiner* — Shantese L McDonald
(74) *Attorney, Agent, or Firm* — Oblon, McClelland, Maier & Neustadt, L.L.P.

(57) ABSTRACT

A polishing apparatus according to an embodiment includes a polishing pad including a polishing surface for polishing a polishing target object and a membrane including a contact surface that is in contact with the polishing target object on the opposite side of the polishing surface. The contact surface is deformed from a flat surface into an uneven surface in response to pressure applied to the membrane.

4 Claims, 7 Drawing Sheets

POLISHING APPARATUS

CROSS-REFERENCE TO RELATED APPLICATIONS

This application is based upon and claims the benefit of priority from Japanese Patent Application No. 2019-164572, filed on Sep. 10, 2019; the entire contents of which are incorporated herein by reference.

FIELD

Embodiments of the present invention relate to a polishing apparatus.

BACKGROUND

When a substrate is polished by a polishing apparatus, the substrate is pressed against a polishing surface of a polishing pad by, for example, pressure applied to a membrane provided in a polishing head. In this case, when the polishing ends, pressure is applied to the membrane again in a place apart from the polishing pad, whereby the substrate is separated from the membrane.

DETAILED DESCRIPTION

Embodiments will now be explained with reference to the accompanying drawings. The present invention is not limited to the embodiments.

A polishing apparatus according to an embodiment includes: a polishing pad including a polishing surface for polishing a polishing target object; and a membrane including a contact surface that is in contact with the polishing target object on an opposite side of the polishing surface. The contact surface is deformed from a flat surface into an uneven surface in response to pressure applied to the membrane.

First Embodiment

Figure 1:
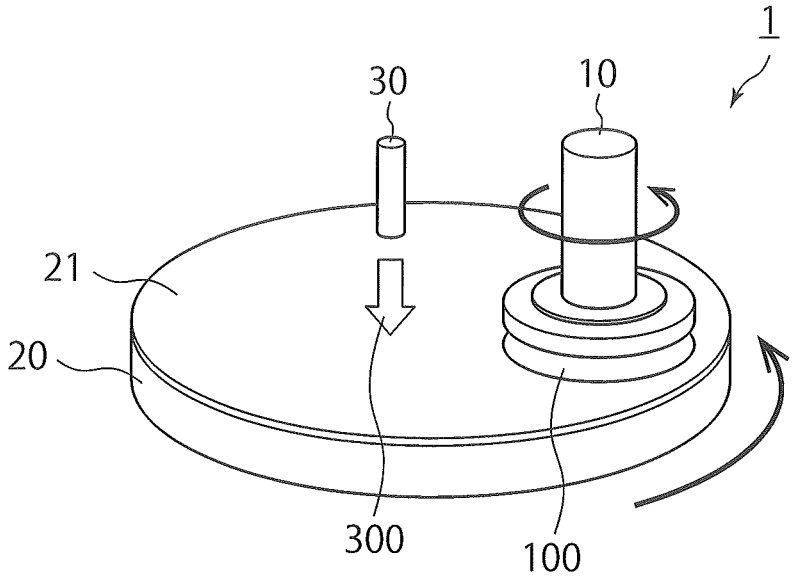
FIG. 1 is a schematic diagram showing a schematic configuration of a polishing apparatus according to a first embodiment.

FIG. 1 is a schematic diagram showing a schematic configuration of a polishing apparatus according to a first embodiment. A polishing apparatus 1 shown in FIG. 1 includes a polishing head 10, a polishing pad 20, and a nozzle 30. The polishing apparatus 1 performs chemical mechanical polishing (CMP) on a wafer-shaped substrate 100.

First, the polishing pad 20 and the nozzle 30 are explained. As shown in FIG. 1, the polishing pad 20 is set in a position opposed to the polishing head 10. The polishing pad 20 includes a polishing surface 21 for polishing the substrate 100. The plane area of the polishing surface 21 is larger than the plane area of the substrate 100. When the polishing pad 20 rotates together with the polishing head 10, a film (for example, an insulating film or a metal film) formed on the surface of the substrate 100 is planarized by the polishing surface 21.

When the substrate 100 is polished, the nozzle 30 discharges slurry 300 from above the polishing pad 20 toward the polishing surface 21. The slurry 300 contains abrasive grains for polishing the substrate 100.

Figure 2:
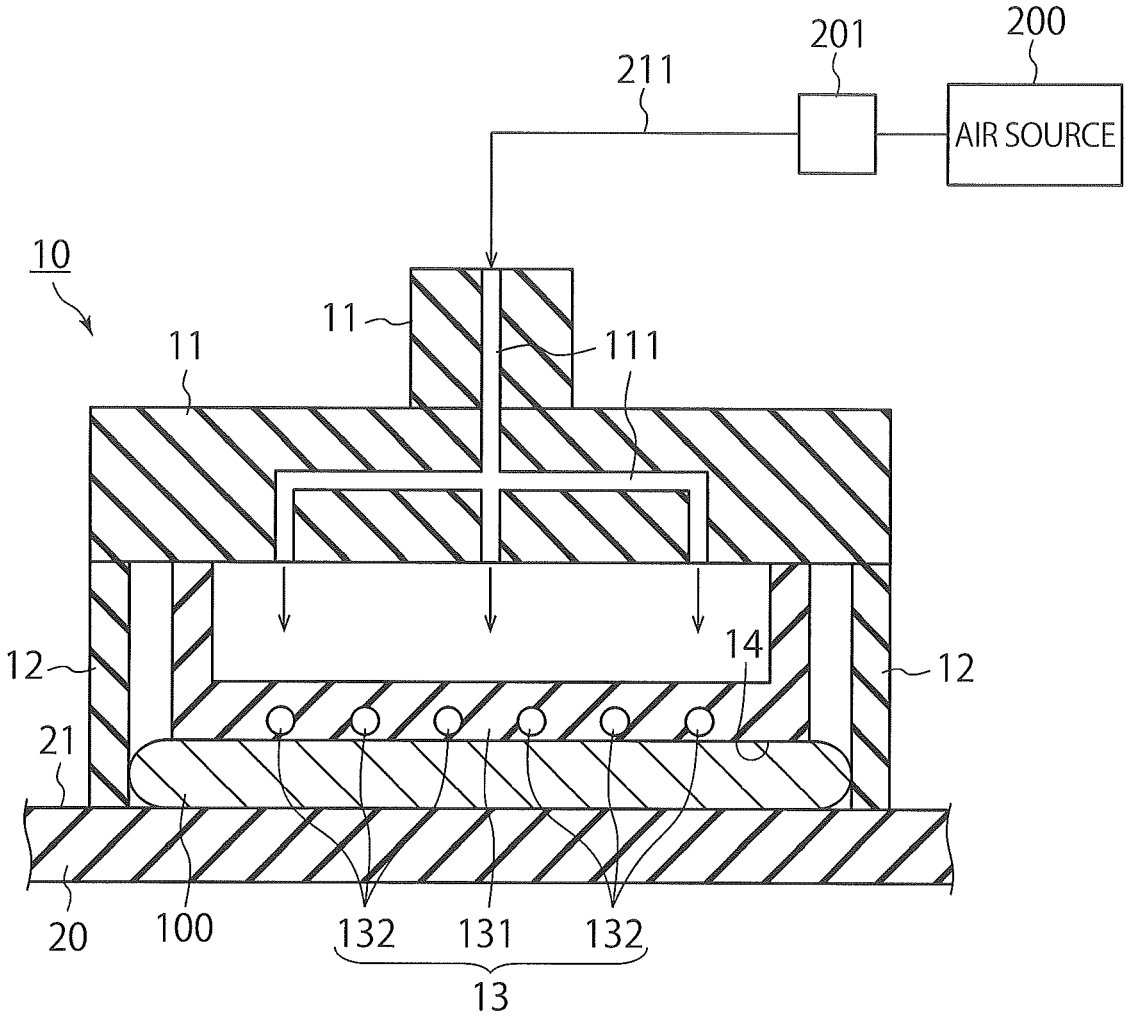
FIG. 2 is a sectional view of a polishing head according to the first embodiment.

The polishing head 10 will be explained. FIG. 2 is a sectional view of the polishing head 10. As shown in FIG. 2, the polishing head 10 includes a support 11, a retainer ring 12, and a membrane 13.

The support 11 supports the retainer ring 12 and the membrane 13. A pipe 111 is formed on the inside of the support 11. Compressed air 211 flows into the pipe 111 from an air source 200. The pressure of the compressed air 211 is adjusted by a valve 201.

The retainer ring 12 is provided along the outer circumference of the substrate 100 under the support 11. When the polishing head 10 rotates, force for moving the substrate 100 to the outer side of the polishing head 10 is generated. However, the substrate 100 can be prevented from jumping out from the polishing head 10 by the retainer ring 12.

The membrane 13 includes an elastic member 131 and air tubes 132. The elastic member 131 is, for example, rubber molded in a concave shape. The air tubes 132 are provided in the elastic member 131.

Figure 3:
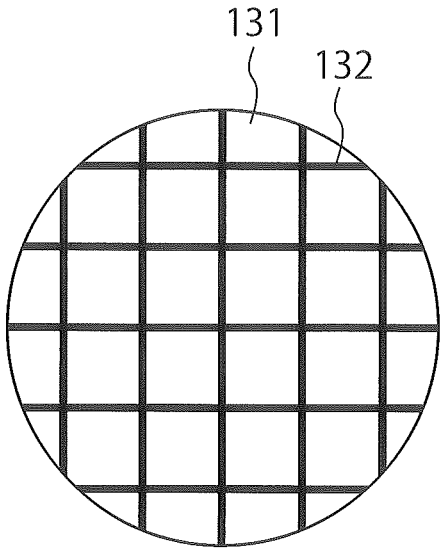
FIG. 3 is a plan view showing arrangement of air tubes.
Figure 4:
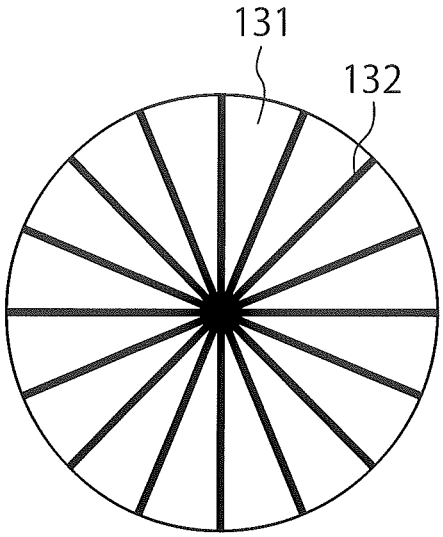
FIG. 4 is a plan view showing other arrangement of the air tubes.

FIG. 3 is a plan view showing arrangement of the air tubes 132. FIG. 4 is a plan view showing other arrangement of the air tubes 132. The air tubes 132 may be arranged in a lattice pattern as shown in FIG. 3 or may be arranged in a radial pattern as shown in FIG. 4.

When the substrate 100 is polished using the polishing apparatus 1 according to this embodiment, the polishing head 10 and the polishing pad 20 rotate. At this time, the membrane 13 is pressurized by the compressed air 211 supplied from the air source 200 through the pipe 111. The membrane 13 presses the substrate 100 against the polishing surface 21 of the polishing head 10 with applied pressure. At this time, a contact surface 14 of the membrane 13 that is in contact with the substrate 100 on the opposite side of the polishing surface 21 is a flat surface as shown in FIG. 2. The air tubes 132 are not in contact with the substrate 100.

Figure 5:
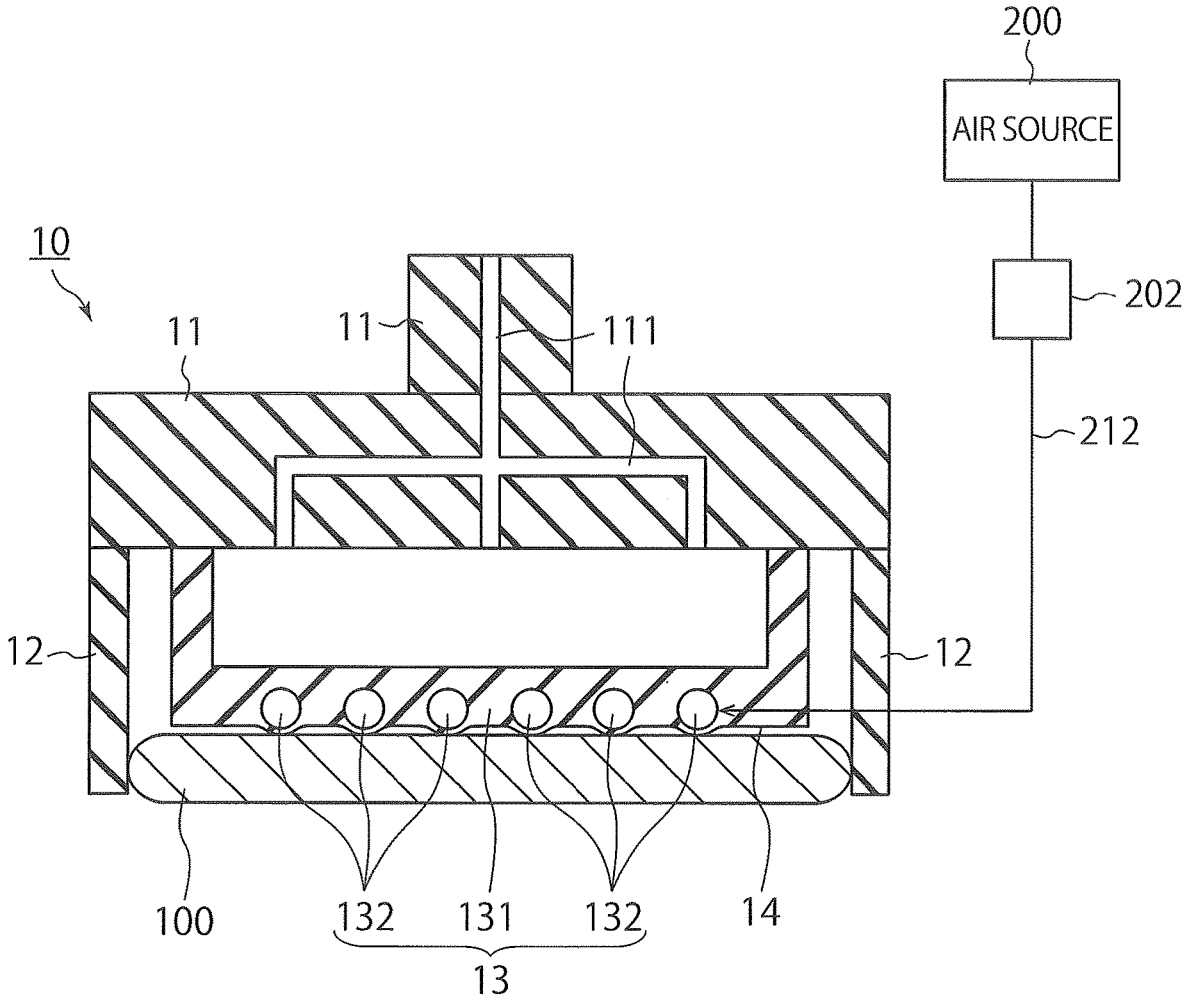
FIG. 5 is a sectional view showing a state at the time when a substrate is separated from the polishing head according to the first embodiment.

FIG. 5 is a sectional view showing a state at the time when the substrate 100 is separated from the polishing head 10. When the substrate 100 polishing ends, the substrate 100 is conveyed to a predetermined place apart from the polishing pad 20. In that place, the air source 200 feeds compressed air 212 into the air tubes 132. The pressure of the compressed air 212 is adjusted by a valve 202.

The air tubes 132 expand with the pressure of the compressed air 212. Consequently, the elastic member 131 is distorted. As a result, the contact surface 14 of the membrane 13 is deformed into an uneven surface as shown in FIG. 5. On the uneven surface, the air tubes 132 form convex portions. However, the air tubes 132 are not in contact with the substrate 100.

According to this embodiment explained above, the air tubes 132 provided in the membrane 13 are expanded, whereby the shape of the contact surface 14 of the membrane 13 is deformed from the flat surface into the uneven surfaces. When the contact surface 14 changes to the uneven surface, adhesion between the membrane 13 and the substrate 100 decreases. Consequently, the substrate 100 easily separates from the membrane 13.

The air tubes 132 are regularly arranged in the lattice pattern or the radial pattern. Accordingly, the uneven surface can be uniformly formed over the entire contact surface 14. Further, since the air tubes 132 are not in contact with the substrate 100, it is also possible to avoid damage to the substrate 100.

Second Embodiment

In the following explanation, about a second embodiment, differences from the first embodiment are mainly explained. A polishing apparatus according to this embodiment is different from the polishing apparatus 1 according to the first embodiment in the configuration of a polishing head.

Figure 6:
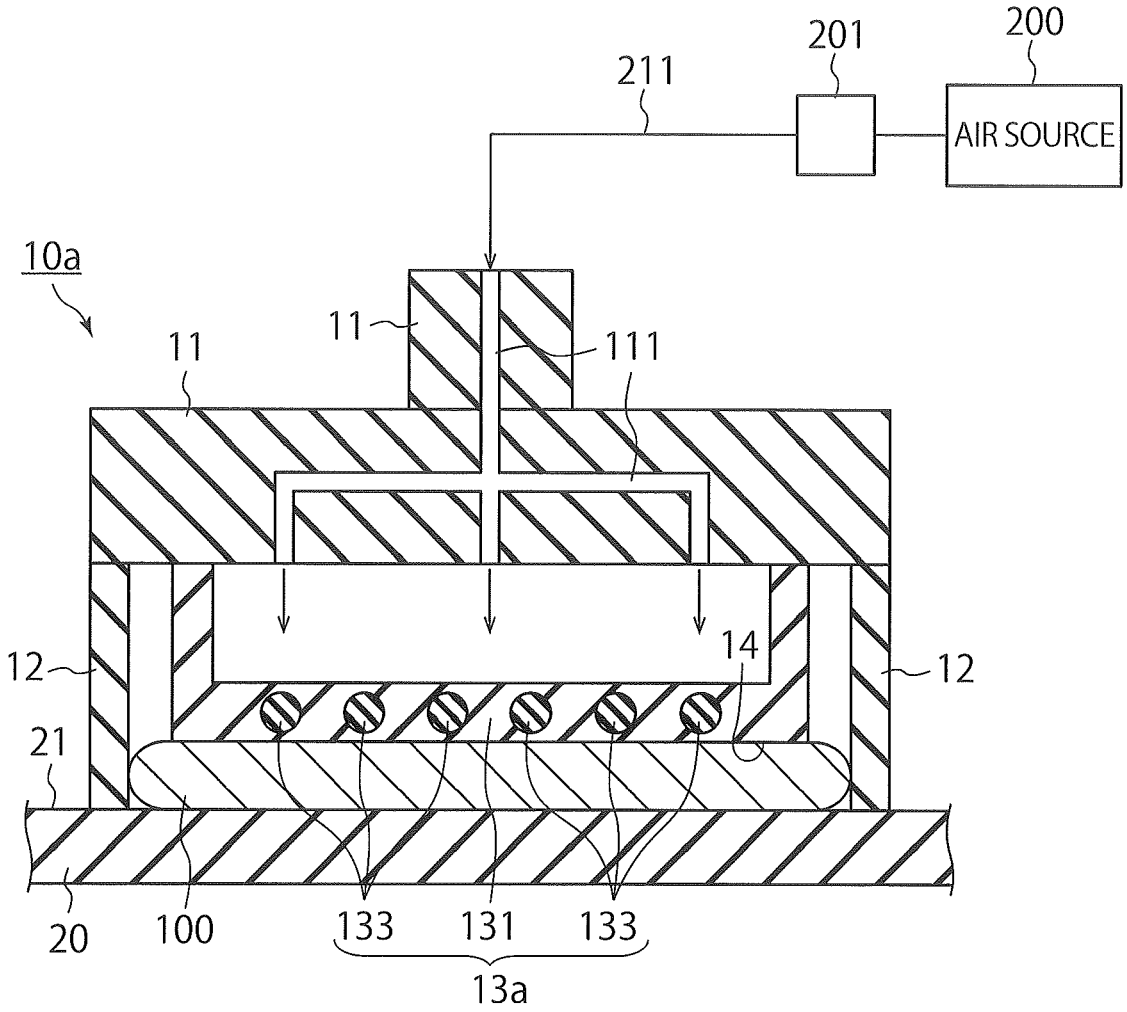
FIG. 6 is a sectional view of a polishing head according to a second embodiment.

FIG. 6 is a sectional view of a polishing head 10*a* according to the second embodiment. The same components as the components of the polishing head 10 according to the first embodiment explained above are denoted by the same reference numerals and signs. Detailed explanation of the components is omitted.

As shown in FIG. 6, the polishing head 10*a* includes a membrane 13*a*. The membrane 13*a* includes the elastic member 131 and hard materials 133 having hardness higher than the hardness of the elastic member 131. The elastic member 131 is rubber molded in a concave shape as in the first embodiment. The hard materials 133 are, for example, glass beads and provided in the elastic member 131.

Figure 7:
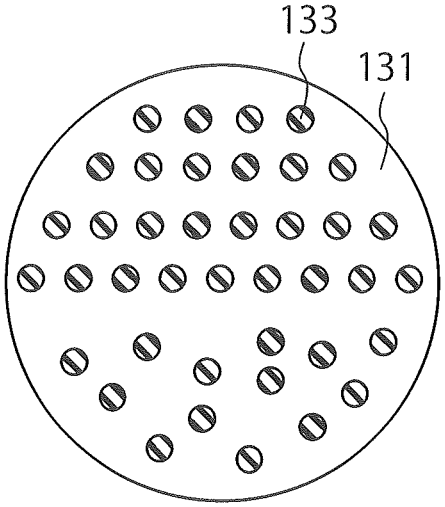
FIG. 7 is a plan view showing arrangement of hard materials.
Figure 8:
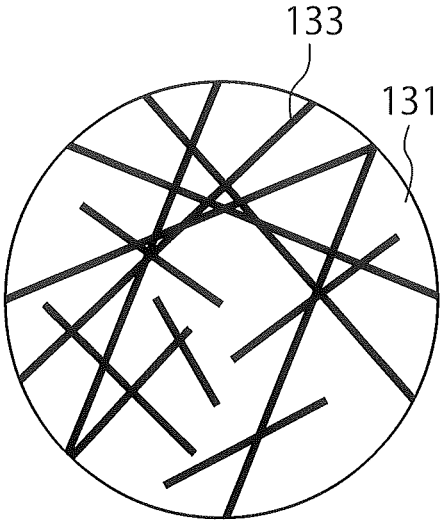
FIG. 8 is a plan view showing other arrangement of the hard materials.

FIG. 7 is a plan view showing arrangement of the hard materials 133. The hard materials 133 are dotted in the elastic member 131 as shown in FIG. 7. The hard materials 133 may be glass fibers as shown in FIG. 8.

In this embodiment, as in the first embodiment, the polishing head 10 and the polishing pad 20 rotate when the substrate 100 is polished. The membrane 13*a* presses the substrate 100 against the polishing surface 21 of the polishing head 10 with the pressure of the compressed air 211. At this time, as shown in FIG. 6, the contact surface 14 of the membrane 13*a* is a flat surface. The hard materials 133 are not in contact with the substrate 100.

Figure 9:
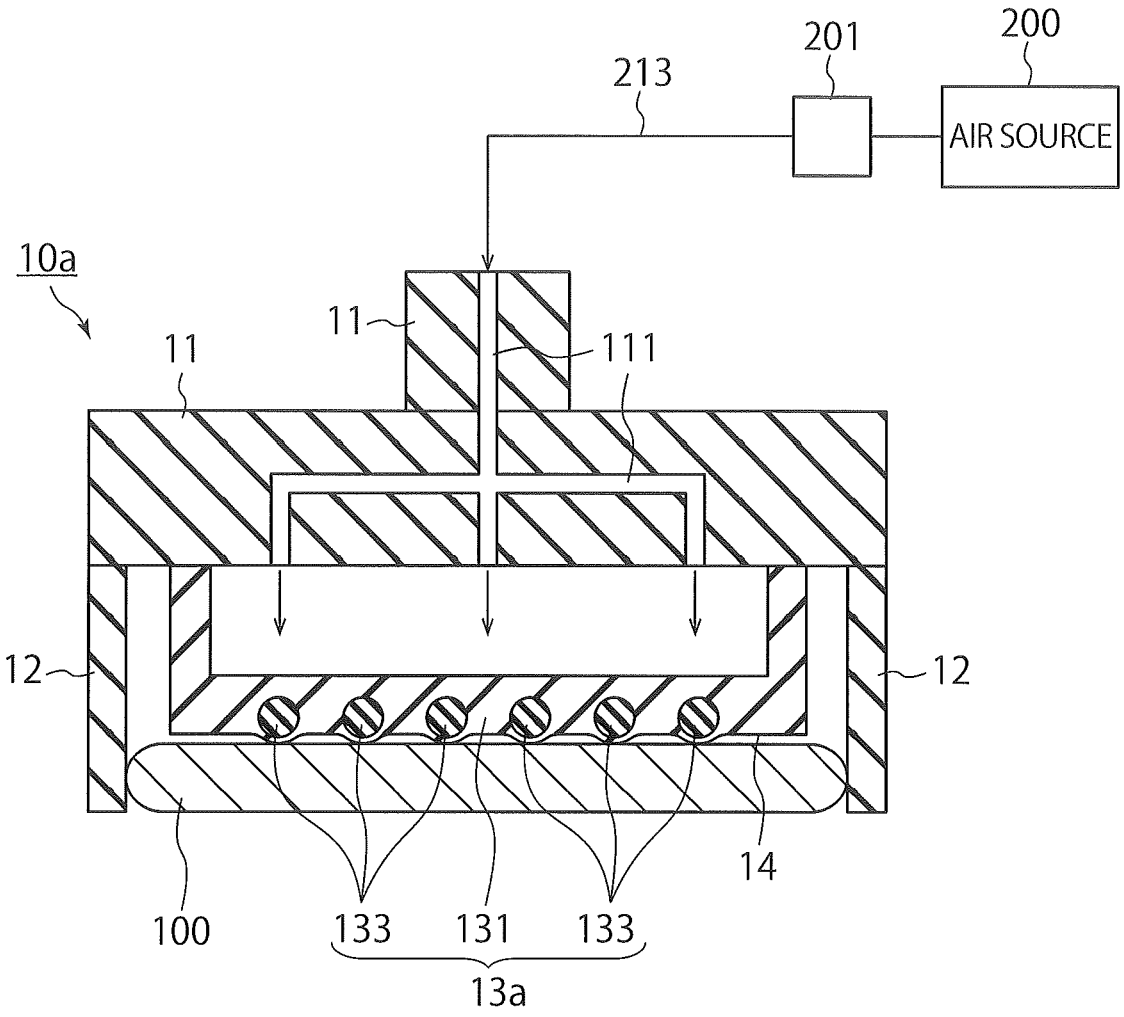
FIG. 9 is a sectional view showing a state at the time when a substrate is separated from the polishing head according to the second embodiment.

FIG. 9 is a sectional view showing a state in which the substrate 100 is separated from the polishing head 10*a*. When the substrate 100 polishing ends, the substrate 100 is conveyed to a predetermined place apart from the polishing pad 20. In that place, the air source 200 feeds compressed air 213 through the pipe 111. The compressed air 213 is adjusted by the valve 201 to pressure higher than the pressure of the compressed air 211 during the polishing.

The elastic member 131 of the membrane 13*a* is pulled in an in-plane direction parallel to the contact surface 14 and distorted by the pressure of the compressed air 213. On the other hand, the hard materials 133 are not deformed because the hard materials 133 have hardness higher than the hardness of the elastic member 131. As a result, the contact surface 14 of the membrane 13*a* is deformed into an uneven surface as shown in FIG. 9. On the uneven surface, the hard materials 133 form convex portions. However, the hard materials 133 are not in contact with the substrate 100.

According to this embodiment explained above, the contact surface 14 of the membrane 13*a* is deformed into the uneven surface using the hard materials 133 contained in the elastic member 131. When the contact surface 14 changes to the uneven surface, as in the first embodiment, adhesion between the membrane 13*a* and the substrate 100 decreases. Consequently, the substrate 100 easily separates from the membrane 13*a*.

According to this embodiment, since the hard materials 133 are not in contact with the substrate 100, it is also possible to avoid damage to the substrate 100.

In this embodiment, the elastic member 131 is deformed with the pressure of the compressed air 212. However, means for deforming the elastic member 131 is not particularly limited if the uneven surface shown in FIG. 9 can be formed.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

The invention claimed is:

1. A polishing apparatus comprising:

a polishing pad including a polishing surface for polishing a polishing target object; and a membrane including a contact surface that is in contact with the polishing target object on an opposite side of the polishing surface, wherein the contact surface is deformed from a flat surface into an uneven surface in response to pressure applied to the membrane, and wherein the membrane includes:

an elastic member configured to be elastically deformed in response to the pressure; and hard materials having hardness higher than hardness of the elastic member, and the hard materials form convex portions on the uneven surface, and wherein the hard materials are not in contact with the polishing target object.

2. The polishing apparatus according to claim 1, wherein the hard materials are glass beads or glass fibers.

3. The polishing apparatus according to claim 1, wherein the hard materials are dotted in the elastic member.

4. The polishing apparatus according to claim 1, further comprising:

an air source configured to supply compressed air to the elastic member; and a valve configured to adjust pressure of the compressed air.

* * * * *